United States Patent [19]

Greer

[11] Patent Number: 4,557,537

[45] Date of Patent: Dec. 10, 1985

[54] ELECTRICAL GROUNDING ARRANGEMENT AND METHOD

[75] Inventor: Carl R. Greer, Louisville, Ky.

[73] Assignee: General Electric Company, Louisville, Ky.

[21] Appl. No.: 612,747

[22] Filed: May 21, 1984

[51] Int. Cl.[4] ..... H01R 4/42; H01R 4/64

[52] U.S. Cl. ..... 339/14 R; 339/95 R; 29/256; 29/432

[58] Field of Search ..... 339/14 R, 14 L, 95 R, 339/95 A, 96, 263 R; 174/51; 29/256, 432

[56] References Cited

U.S. PATENT DOCUMENTS

| | | | |
|---|---|---|---|
| 1,921,823 | 8/1933 | Hosking | 339/272 R |
| 3,044,165 | 7/1962 | Munse | 29/532 |
| 3,467,938 | 9/1969 | Jahr | 339/4 |
| 3,648,222 | 3/1972 | Cowmeadow | 339/14 |
| 3,693,130 | 9/1972 | Pankow | 339/14 |
| 4,170,391 | 10/1979 | Bottger | 312/214 |
| 4,223,586 | 9/1980 | Miller | 411/15 |

*Primary Examiner*—Neil Abrams

*Attorney, Agent, or Firm*—Frederick P. Weidner; Radford M. Reams

[57] ABSTRACT

An electrical ground connection arrangement and method between two metal elements wherein a first metal element has an aperture with a tab extending from the aperture periphery and the second metal element has an aperture and a slot radially outwardly of the aperture to receive the tab of the first metal part. An externally threaded metal fastener is passed through the first and second metal element apertures which fastener bends the tab and scores it so that there is metal-to-metal contact between the fastener and the tab and second metal element.

8 Claims, 7 Drawing Figures

ELECTRICAL GROUNDING ARRANGEMENT AND METHOD

BACKGROUND OF THE INVENTION

This invention relates generally to an electrical ground connection arrangement between two metal elements and more particularly to a means of electrically grounding appliance components made of sheet metal. Cabinets for major appliances are commonly fabricated from painted steel sheet metal and these cabinets have within them various electrical components which can possibly provide electrical shock hazard to a person touching the outer metal case if the entire system including the components made of sheet metal are not sufficiently grounded electrically. As an example it is often desirable to provide a partition within a refrigerator for separating the refrigerator into first and second compartments such as a freezer compartment and a fresh food compartment. It is further desirable to have the partition constructed in such a manner that there can be a mullion across the front of the partition and secured to the cabinet outer case to afford a pleasing appearance. Behind the mullion in many cases there is an electrical resistance heater referred to as an anti-sweat heater which prevents moisture from condensing on the exterior surface of the refrigerator in the mullion area. The mullion is faced with a painted metal strip which needs to be properly grounded to the entire case and electrical system through the connection plug of the appliance to the wall receptacle. Heretofore grounding the painted metal strip was commonly done by a screw fastener with a barbed washer that would score through the paint coating into the underlying bare metal. This type of grounding arrangement is undesirable as the scored paint surface is susceptible to rusting which in time will become unsightly and is visible to the user.

By my invention there is provided an electrical grounding arrangement and method that is effective for joining two metal elements and it is particularly useful if one of the metal elements has an external coating of paint that needs to be scored to make a grounding connection.

SUMMARY OF THE INVENTION

There is provided an electrical ground connection arrangement for two metal elements and method wherein the first metal element has an aperture with a periphery and a tab extending from the aperture periphery and departing the plane of the first metal element. A second metal element has an aperture with a periphery and this aperture has a slot radially outwardly of the aperture periphery that receives therein the tab of the first element. An externally threaded metal fastener is inserted through the first and second metal element apertures and the fastener scores the tab of the first metal element and is in metal-to-metal contact with the tab and second metal element.

DESCRIPTION OF THE PREFERRED EMBODIMENT

Figure 1:
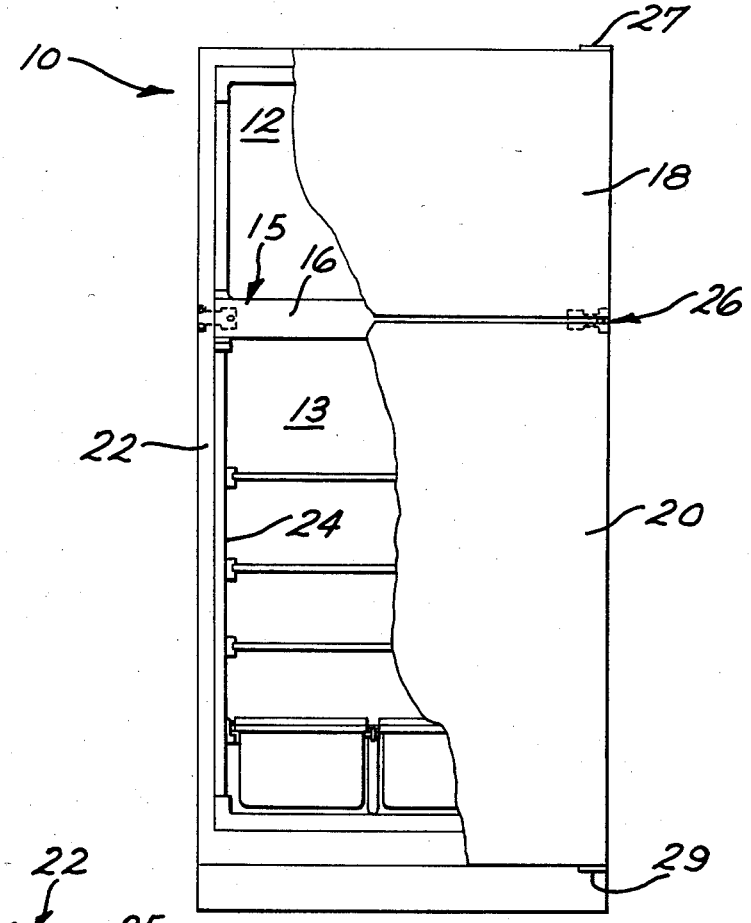
FIG. 1 is a front elevational view, partly broken away, of a top mount refrigerator showing both the fresh food compartment below and the freezer compartment above and including the partition and mullion between the two compartments and shows the location of the electrical grounding arrangement.

Referring to FIG. 1, a refrigerator 10 such as a top mount household refrigerator, for example, has a freezing compartment 12, and a fresh food compartment 13 separated by an insulated partition 15 having a forwardly positioned mullion 16. The freezer compartment has a door 18 and the fresh food compartment has a door 20 for closing the respective compartments. The refrigerator 10 has a cabinet outer metal case 22 which envelops both the freezer and fresh food compartments. The freezer and fresh food compartments have an interior liner 24 which is usually made of plastic material. Between the inner liner 24 and the outer case 22 there is insulation 25 (FIG. 2).

Figure 2:
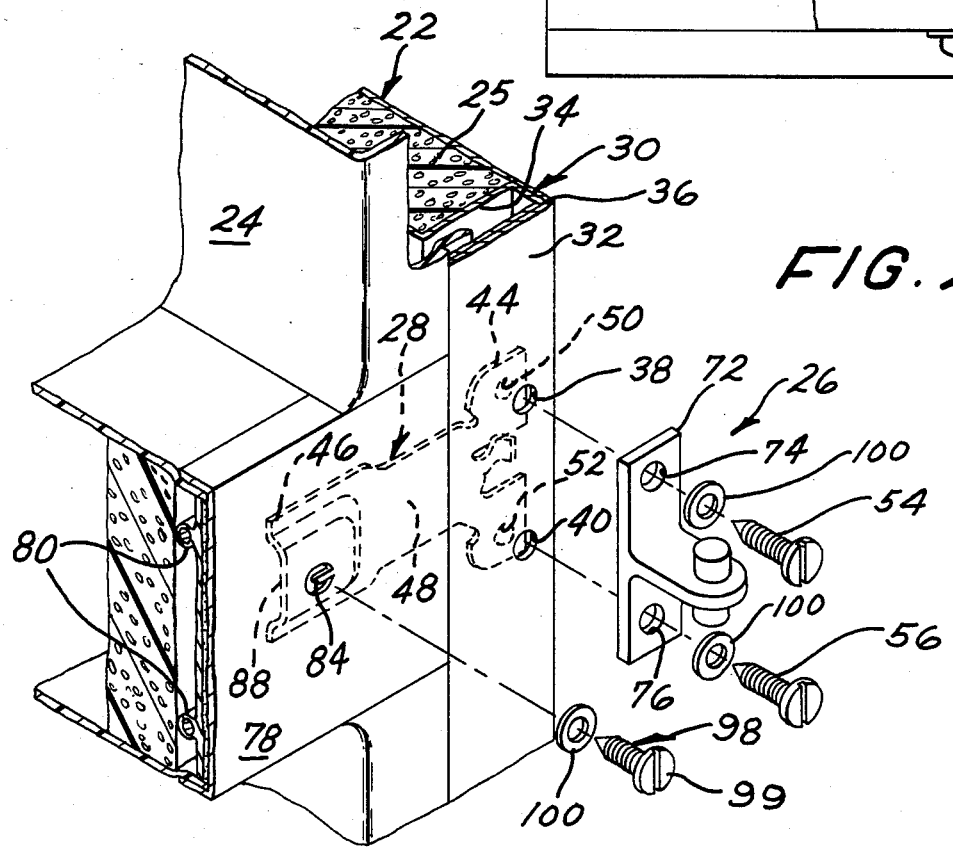
FIG. 2 is an exploded perspective view showing the support arrangement for the hinged door and the electrical grounding arrangement specifically for use with the mullion.
Figure 3:
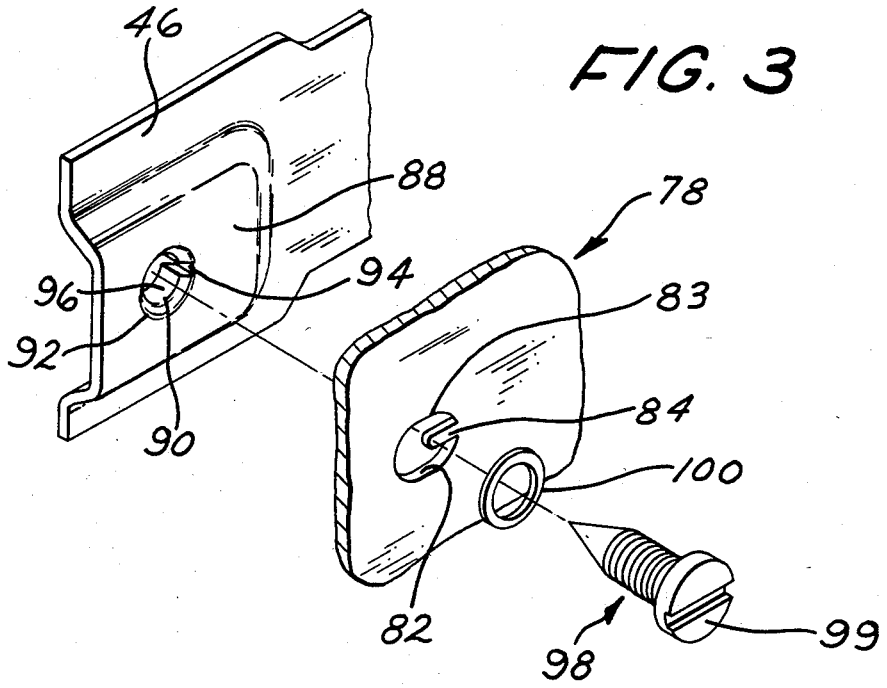
FIG. 3 is an exploded perspective view of the electrical grounding arrangement of the present invention.

One end of both the freezer door 18 and the fresh food door 20 is hingedly supported by the case 22 by means of a hinge pin assembly 26 as shown in FIG. 2. The other end of each door is hingedly supported by hinge pins 27 and 29 at the top and bottom respectively of the refrigerator. To secure the mullion 16 to the case 22 and the hinge pin assembly 26 to the case 22 there is utilized a cross piece support member designated generally as element 28.

The cabinet or outer case 22 is made from sheet metal and is formed to provide a U-shaped portion 30 which includes an outer leg 32 and an inner leg 34 spaced from the outer leg, both legs of which are connected by a central portion 36. The U-shaped portion 30 is formed by reverse bending the sheet metal to provide a double thickness co-extensive with the outer leg 32 and central portion 36 and a single thickness for the inner leg 34. There is thus formed a channel into which will be received the cross piece support member 28. The outer leg 32 is provided with two openings 38 and 40 which are disposed in vertical alignment one with the other and are dimensioned to receive any suitable fastener elements.

Cross piece support member 28 may be formed from a single sheet of metal and is generally T-shaped. It has a first end 44, a second end 46 and a central portion 48 connecting the first and second ends. The first end 44 has two threaded openings 50 and 52 for receiving therein in threaded engagement fastener elements 54 and 56.

The hinge pin assembly 26 is secured to the outer case by abutting the base 72 of the hinge pin assembly 26 to the surface of the outer leg 32 with fastener openings 74 and 76 in horizontal alignment with openings 38 and 40 of the case and also threaded openings 50 and 52 of the cross piece support member. When all of the components are in proper position, then threaded fastener elements 54 and 56 will engage the threaded openings 50 and 52 of the cross piece support member 28 and secure the hinge pin assembly 26 the outer case 22 and also the cross piece support member 28. The second end 46 of the cross piece support member 28 is secured and electrically grounded to mullion 16 and that connection will be described below in detail.

With reference particularly to FIGS. 2–7 two metal elements to be electrically grounded are represented in this description as end 46 of the cross piece support member 28 and the mullion 16 metal cover sheet 78. There is behind the cover plate 78 an electrical resistance heater 80 which is utilized to heat the mullion 16 to prevent moisture from condensing onto the cold surface of the cover sheet 78 and producing droplets of water on the surface. These heaters are referred to as anti-sweat heaters. Since they are energized by full line voltage, it is important that the metal surfaces around the electrical resistance heater be electrically grounded in the event there is a short to prevent a person from being subjected to electrical shock. The mullion metal cover sheet 78 is to be grounded to the cross piece support member 28 which is grounded to the outer case 22. The outer case 22 is grounded through the refrigerator plug to a household receptacle. The problem with providing a good electrical ground connection is made more difficult when one of the metal elements, in this case the mullion cover sheet 78, is made of painted steel. The problem of course is how do you prevent the paint coating on the surface from interferring with a good electrical ground connection between that element and the other metal element. Heretofore the usual means for getting metal-to-metal contact through the fastener was by providing a star washer with barbed ends that would rotate as the fastener was tightened and the rotation would cause the barbs to bite through the paint coating and score into the metal. While this may provide a good ground connection, it destroys the paint finish and the protection that it gives to the sheet metal against rusting. This is particularly true in a refrigerator which is susceptible to moisture in the mullion area that will cause rust spots.

The first metal element which is the painted metal cover sheet 8 has formed therein an aperture 82 having a periphery 83 and a bendable tab 84 extending from the aperture periphery 83 toward the center of the aperture. The metal cover sheet 78 has an external coating of paint 86 as most clearly seen in FIGS. 4–7.

The second metal element which is end 46 of cross piece support member 28 has a raised section 88 which has formed therein an aperture 90 having a periphery 92 and a slot 94 radially outwardly of the aperture periphery 92. There is formed around the periphery of the aperture an embossment 96 which departs the plane of the raised section 88 of end 46 of the cross piece support member 28 in a direction away from the side the first metal element is to be secured to.

Figure 4:
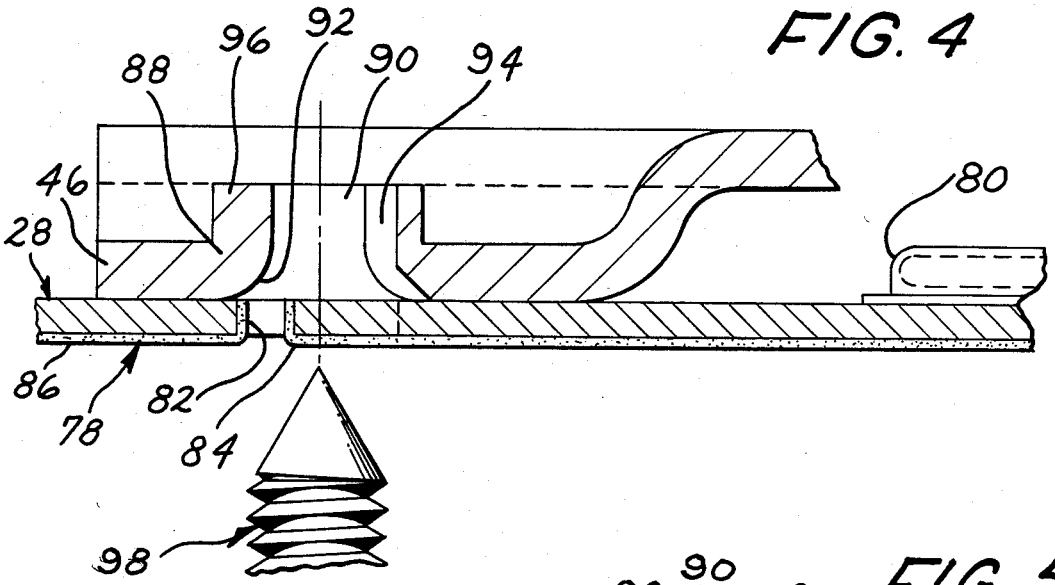
FIG. 4 shows the electrical grounding arrangement of the present invention prior to securing the fastener to the two metal elements to be electrically grounded.
Figure 5:
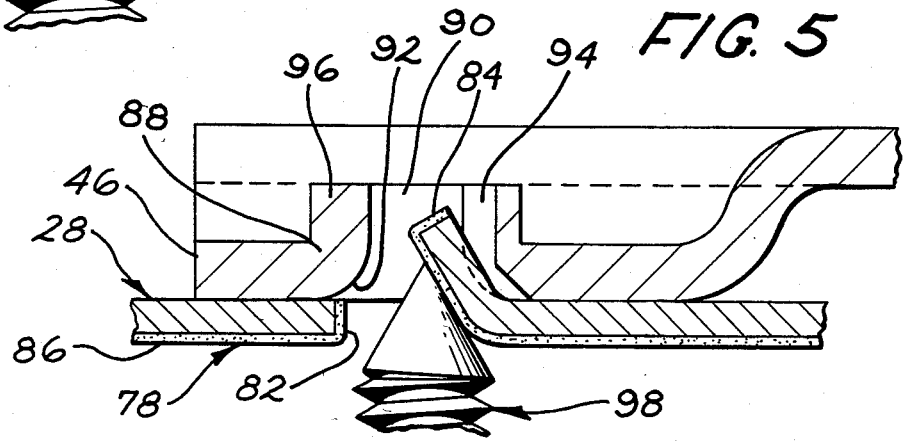
FIG. 5 shows the electrical grounding arrangement of the present invention with the fastener entering the apertures in the first and second metal elements.
Figure 6:
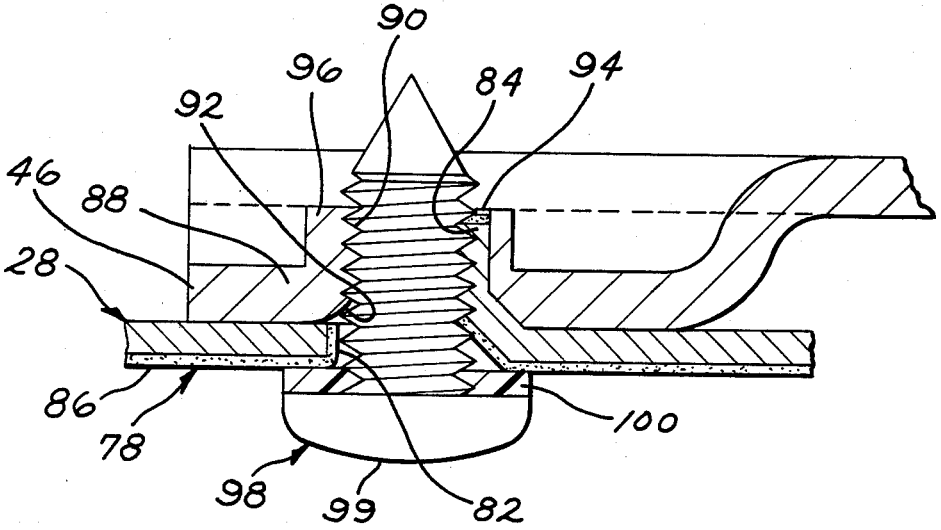
FIG. 6 shows the completed electrical grounding arrangement of the present invention.
Figure 7:
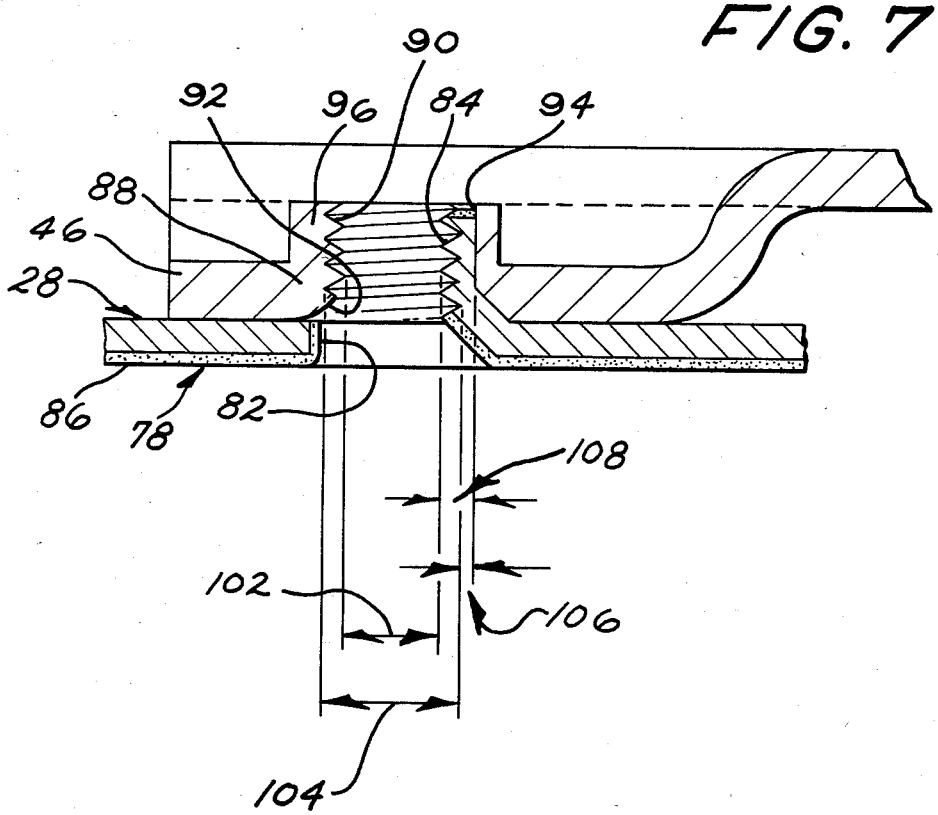
FIG. 7 shows the completed electrical grounding arrangement of FIG. 6 but with the fastener removed.

The assembly operation is accomplished by overlying the first and second metal elements which are 78 and 88 with the respective apertures 82 and 90 in alignment as shown in FIG. 4. An externally threaded metal fastener 98 is inserted into aperture 82 of the metal cover sheet 78 and by forcing the fastener through the aperture it will bend the tab 84 into the slot 94 of the second sheet metal element which in this preferred embodiment is raised section 88 and then upon tightening the fastener the threads of the fastener will score the tab thereby piercing the coating of paint 86 and securely join the fastener 98 and both the first metal element 78 and the second metal element 88 together in metal-to-metal contact. The tab 84 and slot 94 should be dimensioned so that when the tab 84 is inserted into the slot 94 it will not break off upon tightening of the fastener. For this purpose it is helpful to consider the fastener thread diameter relative to the distance the slot 94 extends from the periphery 92 of the aperture 90. In FIG. 7 the thread diameter of the fastener is shown after the fastener has been removed with the minor thread diameter designated 102 and the major diameter designated as 104. The slot 94 should extend a distance 106 beyond the major thread diameter sufficient to prevent breaking off the tab upon tightening the fastener to complete the connection. The distance 106 may be approximately a fourth to three-fourths the thickness of tab 84. Generally the slot 94 should extend from the periphery 92 of the aperture 90 a distance of half the difference between the minor and major thread diameter plus approximately a fourth to three-fourths the thickness of tab 84 and that distance is designated 108 in FIG. 7. It will be noted as particularly shown in FIGS. 6 and 7 that the embossment 96 of the second metal element is utilized in the case of relatively thin metal to increase the length of the metal engaged by the threads of the fastener 98 to thereby give good structural support and electrical contact between the two. It will also be noted again particularly in FIGS. 6 and 7 that the threads of the fastener also engage a substantial length of the first metal element by digging into the tab 84 along its length. The fastener can be a self-tapping type or a machine fastener which in the latter case would require having matching threads around the aperture 90 to receive the machine fastener. With the tab 84 being received in slot 94 it would not interfere with mating the respective threaded surfaces of aperture 90 and fastener 98.

In the preferred embodiment when the electrical ground connection is utilized in any area prone to rusting there may be provided a resilient or water resistant washer 100 between the head 99 of fastener 98 and the first metal element 78 to help prevent any entry of moisture into the threaded connections between the first and second metal elements. In this manner the painted metal cover sheet 78 will not show rust spots and yet there is provided a good, firm, easy to assemble, electrical ground connection arrangement.

While the specific embodiment and method of this invention has been illustrated and described herein, it is realized that numerous modifications and changes will occur to those skilled in the art. It is therefore to be understood that the appended claims are intended to cover all such modifications and changes as fall within the true spirit and scope of this invention.

What is claimed is:

1. An electrical ground connection arrangement for two metal elements comprising:

a first metal element with an aperture having a periphery and an integral tab with a thickness and extending from the aperture periphery and departing the plane of the first metal element, said tab having a length no greater than the diameter of the aperture, a second metal element with an aperture having a periphery and a slot radially outwardly of the aperture periphery, said slot having inserted therein the tab of the first metal element, and an externally threaded metal fastener having a minor and major thread diameter through the first and second metal element apertures which fastener bends the tab in the insertion direction of the fastener through the apertures into the slot of the second metal element, scores the tab of the first metal element and is in metal-to-metal contact with the tab and second metal element, said fastener, slot and tab being dimensioned such that the slot extends from the second metal element aperture periphery a distance of half the difference between the minor and major diameter of the fastener plus approximately a fourth to three-fourths the thickness of the tab.

2. The electrical ground connection arrangement of claim 1 wherein the second metal element has an embossment around the periphery of the aperture which embossment departs the plane of the second element in a direction away from the first metal element and the externally threaded metal fastener is received in the embossment.

3. The electrical ground connection arrangement of claim 1 wherein the first metal element has an external coating of paint on the surface opposite from the second metal element.

4. The electrical ground connection arrangement of claim 3 wherein the threaded metal fastener has a head and there is located between the head and first metal element a water resistant washer.

5. The method of electrically grounding two metal elements comprising:

forming in a first metal element an aperture having a periphery with a bendable tab extending from the aperture periphery toward the center of the aperture, said tab having a length no greater than the diameter of the aperture, forming in a second metal element an aperture having a periphery with a slot extending radially from the aperture periphery away from the aperture, said slot being dimensioned to receive the bendable tab, overlying the first and second metal elements with the respective apertures in alignment, forcing an externally threaded metal fastener having a minor and major thread diameter through the aperture in the first metal element thereby bending the tab in the insertion direction of the fastener through the aperture and inserting it into the slot of the second metal element, and tightening the fastener to score the tab and securely join the fastener and both first and second metal elements together in metal-to-metal contact, said fastener, slot and tab being dimensioned such that the slot extends from the second metal element aperture periphery a distance of half the difference between the minor and major diameter of the fastener plus approximately a fourth to three-fourths the thickness of the tab.

6. The method of electrically grounding two metal elements according to claim 5 wherein an embossment is formed around the periphery of the aperture in the second metal element to depart the plane of the second metal element in a direction away from the side the first metal element is to be secured to.

7. The method of electrically grounding two metal elements according to claim 5 wherein the first metal element has a paint coating on the surface opposite from the second metal element.

8. The method of electrically grounding two metal elements according to claim 7 wherein the externally threaded metal fastener has a head and a water resistant washer is placed between the head of the fastener and the first metal element prior to forcing the externally threaded fastener through the apertures in the first metal element.

* * * * *